US008205418B2

(12) United States Patent
Napravnik

(10) Patent No.: US 8,205,418 B2
(45) Date of Patent: Jun. 26, 2012

(54) DEVICE AND METHOD FOR THERMALLY TREATING PACKAGED GOODS

(75) Inventor: Christian Napravnik, Rosenheim (DE)

(73) Assignee: Krones AG, Neutrabling (DE)

( * ) Notice: Subject to any disclaimer, the term of this patent is extended or adjusted under 35 U.S.C. 154(b) by 0 days.

(21) Appl. No.: 12/660,806

(22) Filed: Mar. 4, 2010

(65) Prior Publication Data

US 2010/0223889 A1 Sep. 9, 2010

(30) Foreign Application Priority Data

Mar. 6, 2009 (DE) ..... 10 2009 003 575

(51) Int. Cl.
*B65B 53/02* (2006.01)

(52) U.S. Cl. ..... 53/557; 53/442

(58) Field of Classification Search ..... 53/127, 53/171, 440, 441, 442, 556, 557
See application file for complete search history.

(56) References Cited

U.S. PATENT DOCUMENTS

| | | | | | |
|---|---|---|---|---|---|
| 4,179,262 | A | * | 12/1979 | Wardt et al. | 431/354 |
| 4,204,379 | A | * | 5/1980 | Mugnai et al. | 53/512 |
| 4,373,505 | A | * | 2/1983 | Koziol | 126/39 E |
| 4,470,807 | A | * | 9/1984 | Hannen | 432/222 |
| 4,597,193 | A | * | 7/1986 | Kallfass | 34/224 |
| 4,773,384 | A | * | 9/1988 | Koziol | 126/41 R |
| 4,877,012 | A | * | 10/1989 | Hannen et al. | 126/99 R |
| 5,213,494 | A | * | 5/1993 | Jeppesen | 431/343 |
| 5,431,557 | A | | 7/1995 | Hamos | 431/7 |
| 5,522,723 | A | | 6/1996 | Durst et al. | 431/328 |
| 5,877,012 | A | | 3/1999 | Estruch et al. | 435/252.3 |
| 5,899,048 | A | * | 5/1999 | Havens et al. | 53/442 |
| 6,701,696 | B1 | * | 3/2004 | Torre | 53/557 |
| 6,915,620 | B2 | * | 7/2005 | Williams | 53/442 |

FOREIGN PATENT DOCUMENTS

| | | | |
|---|---|---|---|
| DE | 21 55 055 | A | 5/1973 |
| DE | 31 18 396 | A1 | 12/1982 |
| DE | 38 26 358 | A1 | 12/1989 |
| DE | 3826358 | A1 * | 12/1989 |
| DE | 43 22 109 | C2 | 1/1995 |
| DE | 10 2007 011 526 | A1 | 9/2008 |
| DE | 10 2007 030 264 | A1 | 1/2009 |
| EP | 0 282 849 | A1 | 9/1988 |

* cited by examiner

*Primary Examiner* — Paul R Durand
*Assistant Examiner* — Eyamindae Jallow
(74) *Attorney, Agent, or Firm* — Davidson, Davidson & Kappel, LLC

(57) ABSTRACT

A device (10) for thermally treating packaged goods by means of a hot air or gas stream (28), particularly for the shrink treatment of film-wrapped goods, such as packs or the like, is disclosed. The device includes a hot gas generator (12) having a gas burner (14) whose combustion products (16) pass into a mixing device (18) via at least one supply opening (38). The mixing device (18) is formed by a channel portion (20) arranged between a conduit portion (22) formed as an inflow area (23) and an outflow area (25), wherein the mixing device (18) comprises at least one opening (32) for supplying the combustion products (16) and for mixing them with the gas stream (26) of the channel portion (20).

17 Claims, 6 Drawing Sheets

DEVICE AND METHOD FOR THERMALLY TREATING PACKAGED GOODS

CROSS REFERENCE TO RELATED APPLICATIONS

This claims the benefit of German Patent Application No. DE 10 2009 003 575.3, filed on Mar. 6, 2009, and hereby incorporated by reference herein.

FIELD OF THE INVENTION

The invention relates to a device for thermally treating packaged goods, particularly film-wrapped goods.

Additionally, the invention relates to a method for thermally treating packaged goods.

BACKGROUND

The packaging of packs and packaged goods often involves films that are shrunk onto the wrapped products by means of heat treatment. Mostly so-called shrink tunnels are used for the heat treatment, in which the shrinking is achieved by means of a stream of hot air or hot gas—also called shrinking gas stream. The shrinking gas stream is generally applied to the side of the packaged units already wrapped with the shrink film in order to shrink the shrink film onto the packaged units and/or packs. In addition, the shrinking gas stream is also directed onto the bottom side of the product wrapped with the shrink film in order to seal, i.e. to melt together or fuse, the overlapping ends of the shrink film located there.

Such devices for generating hot gas for shrinking plastic films are known, for example, from DE 31 18 396 A1 and DE 38 26 358 A1.

The shrinking gas stream is provided by a hot gas or shrinking gas heater, which comprises at least one heating means operated, for example, by electricity or a gaseous or liquid fuel. A corresponding burner unit comprising a porous element with a gas stream passing therethrough for burning fuel gas and for generating heat is disclosed in DE 10 2007 030 264 A1. The heated gas passing through the porous element is fed into process air forming the shrinking gas stream.

Furthermore, a burner for a gas/air mixture is known from DE 43 22 109 C2. Such hot gas generators are additionally disclosed in DE 10 2007 011 526 A1 and EP 0 282 849 A1.

SUMMARY OF THE INVENTION

It is an object of the invention to provide a system for generating a hot gas stream allowing to uniformly heat large amounts of air over a short distance and with a minimum of pressure loss and enable a heat shrinking treatment of film-wrapped goods.

The present invention provides a device for thermally treating packaged goods using a hot air or gas stream, for a shrink treatment of film-wrapped goods, such as packs or the like, comprising:

a hot gas generator including a gas burner;

a mixing device for receiving combustion products from the gas burner, wherein the mixing device receives the combustion products via at least one supply opening;

a conduit portion defining an inflow area and an outflow area, wherein the mixing device is formed by a channel portion arranged between conduit portion formed as an inflow area and an outflow area;

at least one opening of the mixing device for supplying the combustion products and for mixing them with the gas stream of the channel portion.

It is a further object of the invention to provide a method for heating large amounts of air over a short distance and with a minimum of pressure loss and provide the hot air for a heat shrinking treatment of film-wrapped goods.

The present invention also provides a method for thermally treating packaged goods comprising the following steps:

providing hot air or a hot gas stream, for a shrink treatment of film-wrapped goods, such as packs or the like;

generating hot gas by means of a gas burner; and supplying hot combustion products of the gas burner, via at least one supply opening to a mixing device formed by a channel portion arranged between an inflow area and an outflow area.

According to a first embodiment of the present invention, the channel portion of the mixing device is arranged between a funnel-like conduit portion narrowing in the flow direction and an expanding diffusor area. This inventive device provides a system for generating a hot gas stream allowing to uniformly heat large amounts of air over a short distance with a minimum of pressure loss by directly mixing it with combustion products.

For mixing the hot gas stream with the air flow to be heated, the mixing device comprises at least one opening for supplying the combustion products and for mixing them with the gas stream of the channel portion.

The channel portion of the mixing device may have a relatively unvarying cross-section in the flow direction. Optionally, however, the channel portion may also be varied in cross-section, as needed, which, in practice, must be determined by trials.

The mixing device may be connected to a hot gas outlet of the gas burner via at least one connecting conduit. Optionally, however, there may also be provided a number of such connecting conduits so that, for example, a relatively long portion of the mixing device may be provided with a number of hot gas supplies, which may serve to heat the air flow uniformly.

According to an advantageous embodiment of the inventive device, the at least one connecting conduit ends in a pipe bundle comprising a number of pipes each arranged to be transverse to the flow direction of the mixing device in its channel portion. If necessary, the pipes may be arranged at an acute angle of less than 90 degrees with respect to the flow direction.

According to a first embodiment of the inventive device, some, several or all pipes of the pipe bundle may be at least partially open at their front ends arranged in the channel portion of the mixing device. This means that the pipes may optionally end with a completely open pipe cross-section at their front ends or may comprise an aperture-like opening that may have an open cross-section smaller than the pipe cross-section. Here, it is to be noted that this embodiment may also include numerous combinations with pipe openings designed and/or placed in different ways.

According to an alternative embodiment of the device, at least some, maybe even most or all pipes of the pipe bundle are closed at their front ends arranged in the channel portion of the mixing device and comprise at least one opening in their shells serving as hot gas outlet through which the hot gas may pass into the air flow to be heated. These two mentioned alternatives with openings at the front or in the shell may optionally also be combined with each other in any conceivable way.

One advantageous embodiment of the inventive device may provide that the at least one opening in the shells of the pipes is designed as a slit extending in parallel to the longitudinal axis of the pipes. Optionally there may also be provided a number of such slits. An alternative embodiment may provide openings that are round, oval or of a different shape, in addition to the slits or instead of the slits. Also, several pipes may each have different configurations so that, for example, at least one of the pipes comprises two or more slits.

It may further be advantageous that the slits vary in width along their longitudinal extension. For example, the slit width may decrease toward the closed pipe front ends.

Optionally the pipes of the pipe bundle may have approximately the same dimensions and preferably unvarying cross-sections along their length. However, alternatives with pipes that narrow and/or expand toward the closed end or nearly any combination of such alternatives may also be contemplated.

The invention further relates to a method for thermally treating packaged goods by means of a hot air or gas stream, particularly for the shrink treatment of film-wrapped goods, such as packs or the like, wherein a hot gas is generated by means of a gas burner and the hot combustion products of the gas burner are supplied to a mixing device via at least one supply opening, wherein the mixing device is formed by a narrowed channel portion arranged between a funnel-like conduit portion narrowing in the flow direction and an expanding diffusor area.

Optionally, however, the inflow area may also have an unvarying channel cross-section and/or a cross-section not narrowing like a funnel. Furthermore, the outflow area may optionally also have an unvarying channel cross-section and/or a cross-section not expanding like a funnel.

Further features, objects and advantages of the present invention will become apparent from the following detailed description of a preferred embodiment of the invention which serves as a non-limiting example and refers to the accompanying drawings. Equal elements generally have the same reference numerals and repeated explanations may be omitted.

BRIEF DESCRIPTION

DETAILED DESCRIPTION

Figure 1:
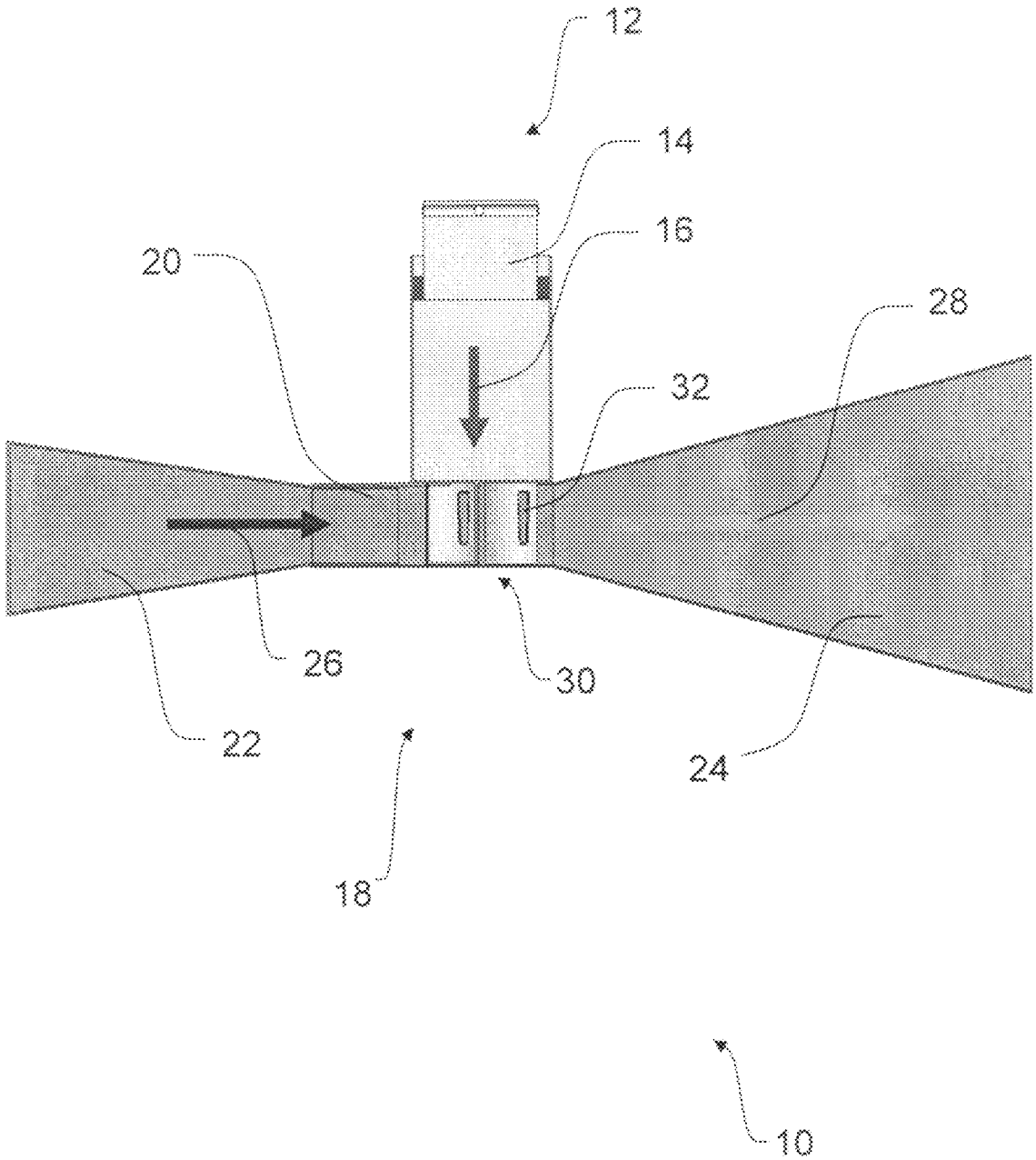
FIG. 1 shows a schematic view of an inventive device for thermally treating packaged goods.

The schematic view of FIG. 1 shows components of an inventive device 10 for thermally treating packaged goods. This device 10 is particularly used for the shrink treatment of film-wrapped goods, such as packs or the like, using a hot air or gas stream. Device 10 includes a hot gas generator 12 having a gas burner 14 whose combustion products 16 are supplied as a hot gas stream to a mixing device 18 formed by a channel portion 20 arranged between a funnel-like conduit portion 22 narrowing in the flow direction and an expanding diffusor area 24. With the help of the shown device 10, a hot gas stream 16 generated by the gas burner 14 is mixed with a cold air stream 26 in the mixing device 18 so that a hot air stream 28 may be discharged from the diffusor portion 24 and used for shrinking the films.

For mixing the hot gas stream 16 with the air flow 26 to be heated, the mixing device 18 comprises an injecting means or injector 30 having a number of openings 32 for supplying the combustion products 16 and for mixing them with the air stream 26 of the channel portion 20. The injecting means 30 is illustrated and explained in detail with reference to FIGS. 5 and 6.

Figure 2:
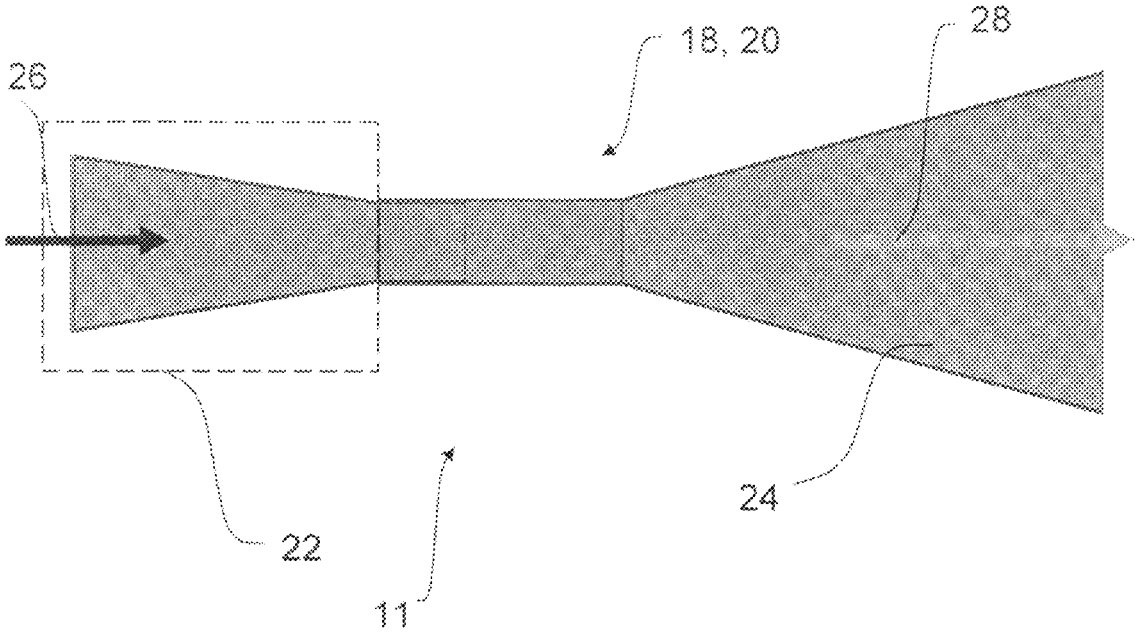
FIG. 2 shows a schematic view of a flow channel of the device shown in FIG. 1.

The schematic view of FIG. 2 shows the structure of a flow channel 11 of the device 10 of FIG. 1 and its essential components. The flow channel 11 includes the conduit portion 22 narrowing like a funnel for the accelerated supply of cold air 26, the middle portion 20 of the channel with the mixing device 18 (cf. FIG. 1) arranged therein, and, downstream thereof, the output diffusor 24 whose cross-section expands funnel-like and which is used for transporting the heated air 28 to the shrink channel (not shown).

As indicated in FIG. 2, the narrower middle portion 20 of the channel comprising the mixing device 18 has a relatively unvarying cross-section in the flow direction.

Figure 3:
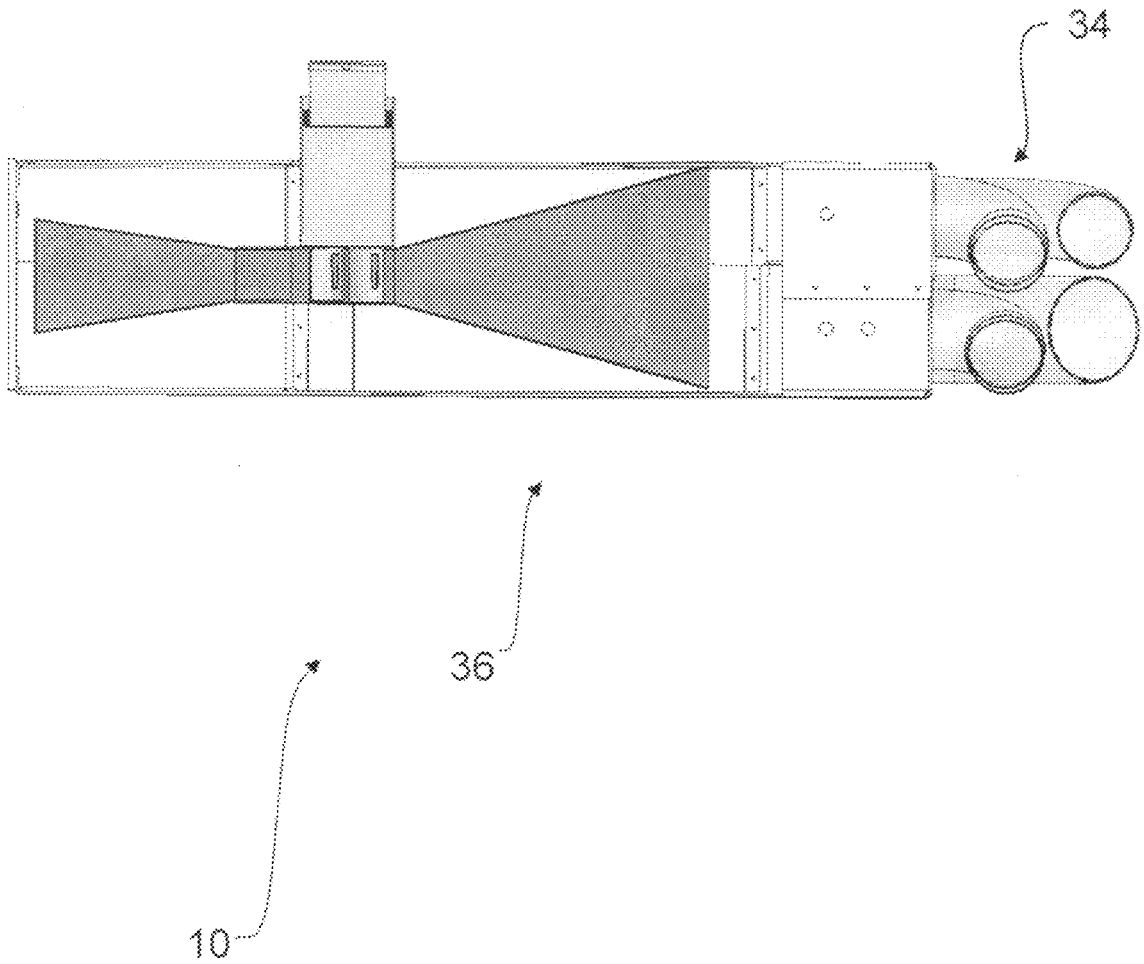
FIG. 3 shows a schematic view of an embodiment of a device for thermally treating packaged goods.

The schematic view of FIG. 3 again shows an embodiment of the device 10 for thermally treating packaged goods with conduits 34 downstream of the diffusor area 24 leading to the shrink tunnel. The entire device 10 is part of a heating chamber 36 of the shrink tunnel.

Figure 4:
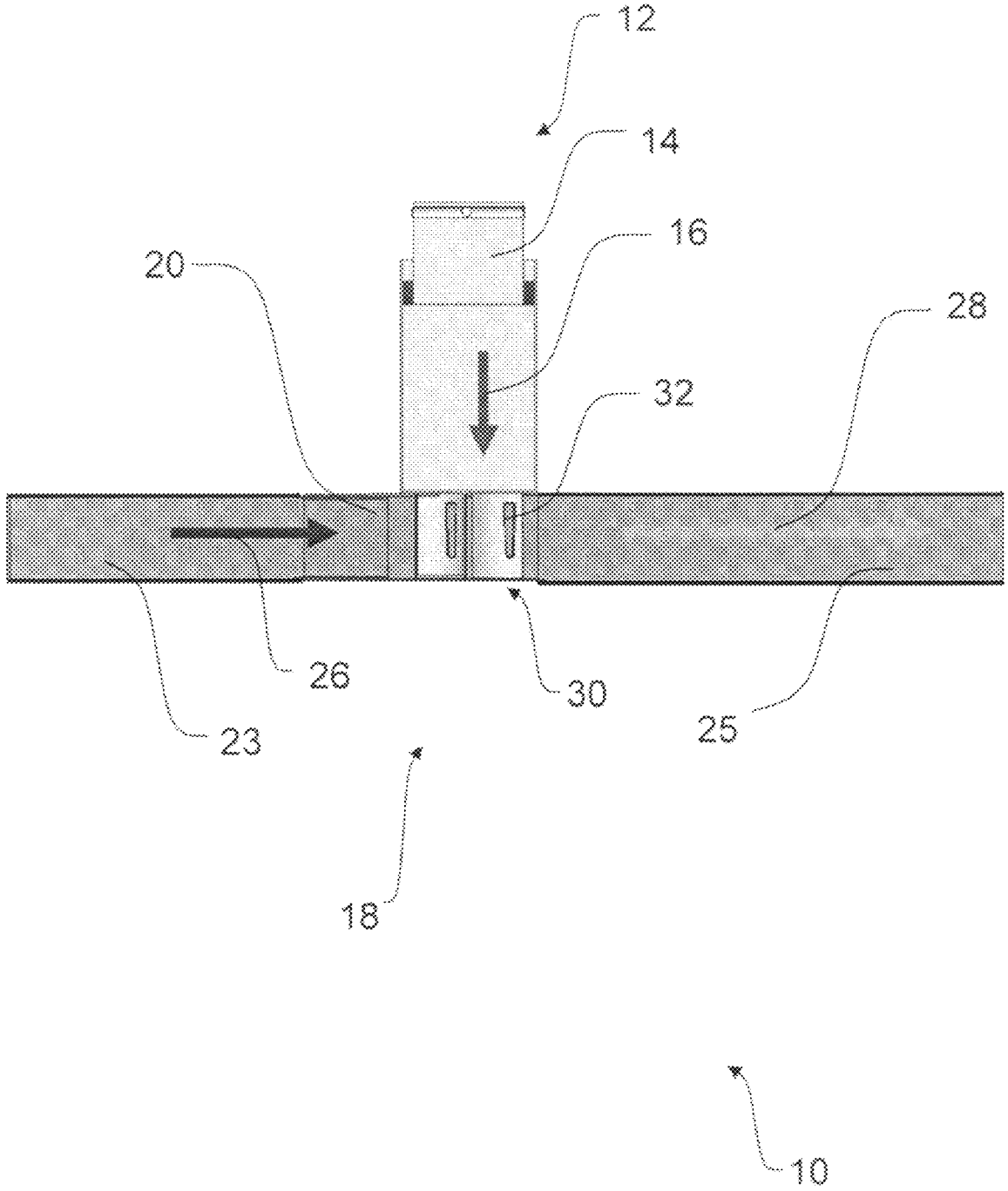
FIG. 4 shows a schematic view of an alternative embodiment of the inventive device for thermally treating packaged goods.

The schematic view of FIG. 4 shows an alternative embodiment of the inventive device 10 for thermally treating packaged goods. FIG. 4 also shows the components of the inventive device 10 for thermally treating packaged goods. Device 10 is used for the shrink treatment of film-wrapped goods, such as packs or the like, using a hot air or gas stream. Device 10 includes a hot gas generator 12 having a gas burner 14 whose combustion products 16 are supplied as a hot gas stream to a mixing device 18 formed by a channel portion 20 arranged between an inflow area 23 having an unvarying cross-section in the flow direction and an outflow area 25 also designed to have an unvarying cross-section in the flow direction. With the help of the shown device 10, a hot gas stream 16 generated by the gas burner 14 is mixed with a cold air stream 26 in the mixing device 18 so that a hot air stream 28 may be discharged from the outflow area 25 and used for shrinking the films.

For mixing the hot gas stream 16 and the air flow 26 to be heated, the mixing device 18 comprises an injecting means 30 having a number of openings 32 for supplying the combustion products 16 and for mixing them with the air stream 26 of the channel portion 20. The injecting means 30 is illustrated and explained in detail with reference to FIGS. 5 and 6. The rest of the device 10 corresponds to the first embodiment illustrated with reference to FIGS. 1 and 3.

Figure 5:
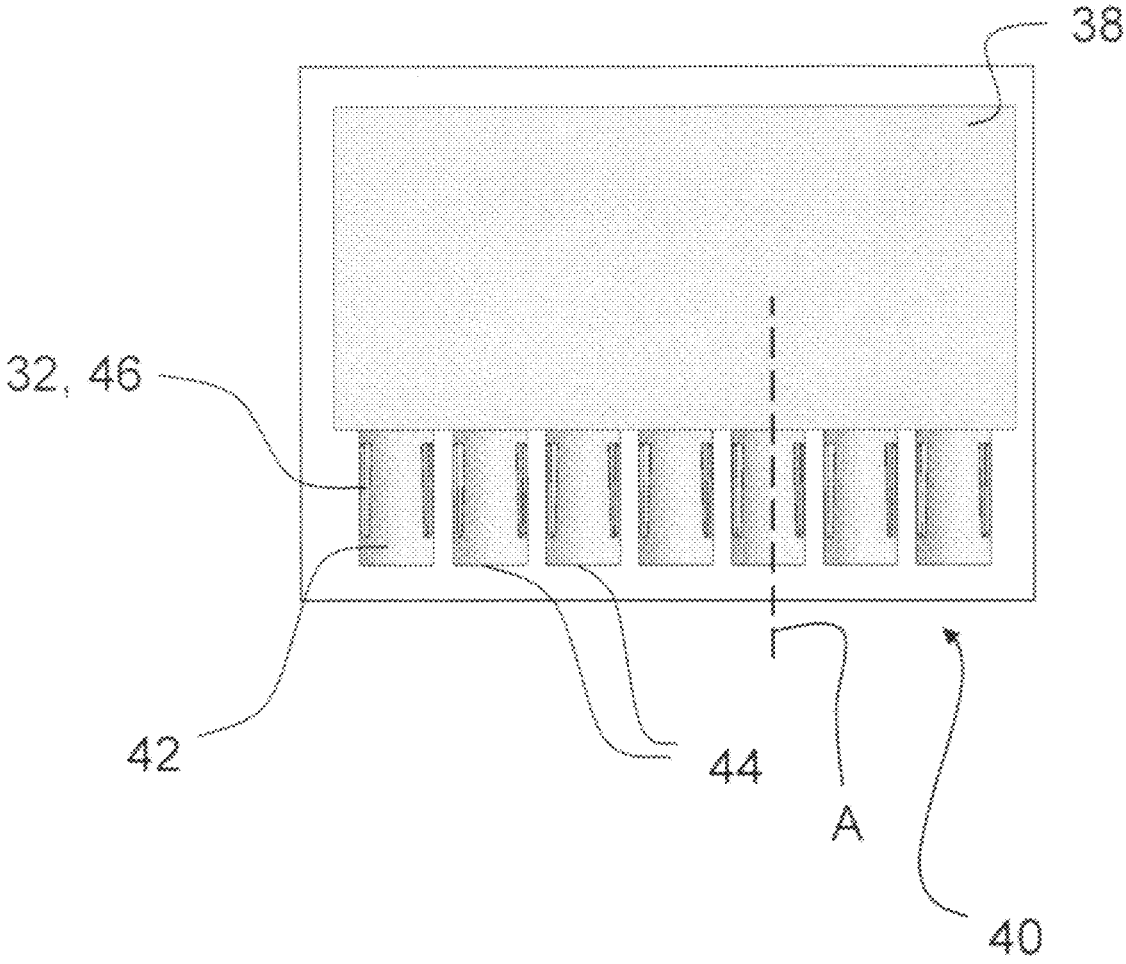
FIG. 5 shows a schematic side view of an injecting means for hot gas.
Figure 6:
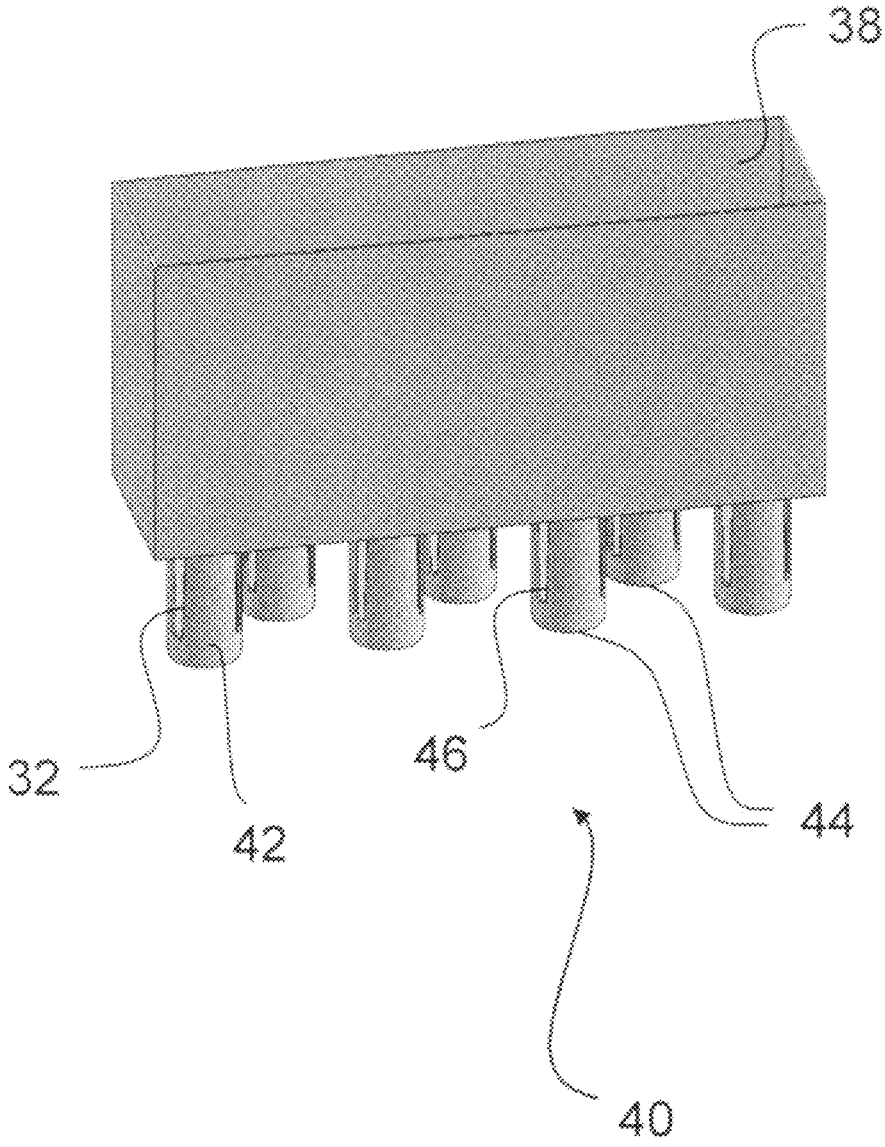
FIG. 6 shows a perspective view of the injecting means shown in FIG. 5.

The schematic illustration of FIG. 5 shows a side view of the injecting means 30 for the hot gas 16, while FIG. 6 shows a perspective view of the injecting means of FIG. 5. The injecting means 30 includes a chamber 38 arranged above the channel portion 20 of the mixing device 18, as may be seen in FIGS. 1, 3 and 4. At its bottom, this chamber 38 ends in a pipe bundle 40 comprising a number of pipes 42, each of which is arranged transverse to the flow direction of the mixing device 18 in its channel portion 20. The pipes 42 of the pipe bundle 40 are closed at their front ends 44 arranged in the channel portion 20 of the mixing device 18 and comprise at least one opening 32 in their shells serving as hot gas outlet through which the hot gas 16 may pass into the air flow 26 to be heated.

As shown in the embodiment, the openings 32 in the shells of the pipes 42 are each formed as slits 46 extending in parallel to a longitudinal axis A of the pipes 42. Optionally, each pipe 42 may comprise only one slit 46 or a number of such slits 46.

Furthermore, the embodiment shown in FIG. 5 and FIG. 6 provides slits 46 each varying in width along the longitudinal extension. Thus the slit width decreases slightly toward the closed pipe front ends 44.

However, it will be apparent to someone skilled in the art that all or some of the slits 46 may optionally also have unvarying slit widths. In addition, there may optionally also be used suitable geometric shapes other than slits, for example round gaps or the like.

The pipes 42 of the pipe bundle 40 have approximately the same dimensions as well as unvarying cross-sections along their length. As can be seen in FIG. 6, the pipes 42 may be arranged in a number of staggered rows next to each other. The arrangement of the chamber 38 and the pipes in the air stream of the channel portion 20 may be implemented variably and/or depending on the given mounting circumstances.

In an embodiment not shown, the pipes 42 may optionally also be designed to be open at the front and may not comprise any of the slits 46 in their shells as shown in FIGS. 5 and 6. For example, some, several or all pipes 42 of the pipe bundle 40 may be at least partially open at the pipe front ends 44 arranged in the channel portion of the mixing device. This means that the pipes 42 may optionally end with a completely open pipe cross-section at their front ends 44 or may comprise aperture-like openings having an open cross-section smaller than the pipe cross-section. In addition, numerous combinations of openings of the pipes 42 designed and/or placed in different ways may be contemplated. The two mentioned alternatives with openings at the front or in the shells may optionally also be combined with each other in any conceivable way.

The invention is not limited to the above embodiments. Instead, a variety of alternatives and modifications is contemplated that make use of the inventive idea and thus fall within the scope of the invention.

What is claimed is:

1. A device for thermally treating packaged goods using a hot air or gas stream, for a shrink treatment of film-wrapped goods comprising:

a hot gas generator including a gas burner;

a mixing device for receiving combustion products from the gas burner, the mixing device receiving the combustion products via at least one supply opening;

a conduit portion defining an inflow area, wherein the mixing device is formed by a channel portion arranged downstream of the conduit portion and upstream of an outflow area;

at least one opening of the mixing device for supplying the combustion products and for mixing them with the gas stream of the channel portion; and an expanding diffuser area and wherein the channel portion of the mixing device is arranged between the conduit portion and the expanding diffusor area, wherein the conduit portion is formed in the shape of a funnel and narrowing in the flow direction.

2. The device as recited in claim 1 wherein the channel portion of the mixing device has an unvarying cross-section in the flow direction.

3. The device as recited in claim 1 wherein the mixing device is connected to a hot gas outlet of the gas burner via at least one connecting conduit.

4. The device as recited in claim 3 wherein the at least one connecting conduit ends in a pipe bundle arranged transverse to the flow direction of the mixing device in its channel portion.

5. The device as recited in claim 4 wherein pipes of the pipe bundle have approximately the same dimensions and unvarying cross-sections along their longitudinal axes.

6. The device as recited in claim 5 wherein the pipes of the pipe bundle are closed at their front ends arranged in the channel portion of the mixing device.

7. The device as recited in claim 6 wherein the pipes each comprise at least one opening in their shells serving as hot gas outlet.

8. The device as recited in claim 7 wherein the at least one opening in the shells of the pipes is formed as a slit extending in parallel to the longitudinal axis of the pipes.

9. The device as recited in claim 8 wherein the slits vary in width along their longitudinal axes.

10. The device as recited in claim 9 wherein the slit width decreases toward the closed pipe front ends.

11. The device as recited in claim 8 wherein at least one of the pipes comprises two or more openings and/or slits in the shell.

12. The device as recited in claim 5 wherein the pipes of the pipe bundle are at least partially open at their front ends arranged in the channel portion of the mixing device.

13. The device as recited in claim 12 wherein the pipes each comprise at least one opening in their shells serving as hot gas outlet.

14. The device as recited in claim 13 wherein the at least one opening in the shells of the pipes is formed as a slit extending in parallel to the longitudinal axis of the pipes.

15. The device as recited in claim 14 wherein the slits vary in width along their longitudinal axes.

16. The device as recited in claim 15 wherein the slit width decreases toward the partially open pipe front ends.

17. The device as recited in claim 13 wherein at least one of the pipes comprises two or more openings and/or slits in the shell.

* * * * *

UNITED STATES PATENT AND TRADEMARK OFFICE

CERTIFICATE OF CORRECTION

PATENT NO. : 8,205,418 B2
APPLICATION NO. : 12/660806
DATED : June 26, 2012
INVENTOR(S) : Christian Napravnik It is certified that error appears in the above-identified patent and that said Letters Patent is hereby corrected as shown below:

ON THE TITLE PAGE:

Item "(73) Assignee", the city should read "Neutraubling." instead of "Neutrabling."

Signed and Sealed this
Twenty-fifth Day of December, 2012

David J. Kappos

David J. Kappos
*Director of the United States Patent and Trademark Office*